US006354900B1

(12) United States Patent
Ohshima et al.

(10) Patent No.: US 6,354,900 B1
(45) Date of Patent: Mar. 12, 2002

(54) ARC TUBE AND FABRICATING METHOD THEREOF

(75) Inventors: Yoshitaka Ohshima; Takeshi Fukuyo; Nobuo Ohkawai; Shinichi Irisawa, all of Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/336,966

(22) Filed: Jun. 21, 1999

(30) Foreign Application Priority Data

Jun. 26, 1998 (JP) ..... 10-179493

(51) Int. Cl.[7] ..... H01J 9/32
(52) U.S. Cl. ..... 445/26; 445/43
(58) Field of Search ..... 445/26, 27, 43

(56) References Cited

U.S. PATENT DOCUMENTS

| | | | | |
|---|---|---|---|---|
| 4,587,454 A | | 5/1986 | Bonazoli et al. | 313/331 |
| 5,277,639 A | | 1/1994 | Nagata et al. | 445/26 |
| 5,286,227 A | | 2/1994 | Numajiri et al. | 445/26 |
| 5,505,648 A | | 4/1996 | Nagasawa et al. | 445/26 |
| 5,936,349 A | * | 8/1999 | Fukai et al. | 445/43 |
| 5,986,403 A | * | 11/1999 | Jansen et al. | 445/26 |

FOREIGN PATENT DOCUMENTS

| | | | |
|---|---|---|---|
| EP | 0 818 805 A2 | 1/1998 | H01J/61/36 |
| EP | 0 871 202 A2 | 10/1998 | H01J/61/36 |
| JP | 60-165400 | 8/1985 | C25F/3/08 |
| WO | WO 96/34405 | 10/1996 | H01J/61/36 |

OTHER PUBLICATIONS

British Combined Search and Examination Report dated Sep. 8, 1999.

British Combined Search and Examination Report dated Jul. 12, 2000.

* cited by examiner

*Primary Examiner*—Kenneth J. Ramsey
(74) *Attorney, Agent, or Firm*—Sughrue Mion, PLLC

(57) ABSTRACT

The pinch-sealing for the first one of a pair of molybdenum foils is not performed by flowing inactive gas within a quartz glass tube like the prior art but performed in a manner that the lower end portion of the quartz glass tube 4 is sealed, and then and a pinch seal estimation portion 4*b* is squeezed by a pincher while air within the quartz glass tube is exhausted from the upper end portion thereof so that pressure within the quartz glass tube becomes in a negative pressure state of 100 torr or less and while heating the pinch seal estimation portion 4*b*. Accordingly, at the time of the squeezing, the inner wall surface 4*c* of the pinch seal estimation portion 4*b* thus heated is attracted to the molybdenum foil 12 side thereby to form fine concave and convex portions on the interfaces between the molybdenum foil 12 and the quartz glass tube 4, so that the molybdenum foil and the quartz glass tube are placed in an engaged state and the contact area therebetween is increased.

7 Claims, 6 Drawing Sheets

EXHAUST
EXHAUST
4
4a
4b
6
8
10
12
24
26
28
30
32
34
IV

ARC TUBE AND FABRICATING METHOD THEREOF

BACKGROUND OF THE INVENTION

1. Field of the Invention

The present invention relates to an arc tube used as a light source etc. of a discharge lamp and a manufacturing method thereof.

2. Description of the Related Art

A discharge lamp is able to irradiate light with high luminance, so that the discharge lamps have been used in many cases as head lights for vehicles, illuminating lights for stores or the like as well as field illuminating lights and road illuminating lights. Arc tube shown in FIG. 1 is knows as a light source of such a discharge lamp.

The arc tube 2 is configured by a quartz glass tube 4 having a spherical portion 4*a* formed at the center portion thereof and a pair of electrode assemblies 6 provided at both sides of the spherical portion 4*a* within the quartz glass tube 4. Each of the electrode assemblies 6 is formed in a manner that an electrode rod 8 protruding within the inner space (discharge room) of the spherical portion 4*a* is coupled to a lead wire 10 protruding from the end portion of the quartz glass tube 4 through a rectangular molybdenum foil 12. Further, each of the electrode assemblies 6 is pinch-sealed by the quartz glass tube 4 at the molybdenum foil 12 portion.

The expression "pinch-seal" in the present specification means such a sealing method that a heated quartz glass tube is squeezed thereby to bury within the quartz glass tube insertion material (molybdenum foil etc.) placed within the quartz glass tube in a state that the insertion material is adhered to the material of the quartz glass tube.

Although the pair of the molybdenum foils 12 are sequentially pinch-sealed one by one, conventionally the pinch-seal process for the first one of the molybdenum foils has been performed in the following manner.

That is, as shown in FIG. 7, the electrode assembly 6 is inserted from the one end portion of the quartz glass tube 4 thereby to place the molybdenum foil 12 in the vicinity of the spherical portion 4*a* within the quartz glass tube 4 ((*a*) of FIG. 7). In this state, inactive gas such as argon gas, nitrogen gas or the like is flown into the quartz glass tube 4 thereby to exhaust the atmosphere within the quartz glass tube 4, and simultaneously a portion of the quartz glass tube 4 surrounding the molybdenum foil 12 is heated by a burner 20 ((*b*) of FIG. 7). Then, the quartz glass tube 4 is squeezed by a pincher 22 ((*c*) of FIG. 7) thereby to perform the pinch-sealing. As a result, the intermediate product of an arc tube shown in (*d*) of FIG. 7 can be obtained.

The aforesaid conventional pinch-seal method is arranged in a manner that, in order to prevent the reduction of tensile strength of the molybdenum foil (breakage of the foil) due to the oxidation of the molybdenum foil, the inactive gas is flowed into the quartz glass tube 4 thereby to exhaust the air causing the oxidation. However, the inner pressure within the quartz glass tube 4 at the time of the pinch-sealing is kept almost at the atmospheric pressure. Thus, as shown in FIG. 8, interfaces 12*a* between the pinch-sealed molybdenum foil 12 and the quartz glass tube 4 are kept in a planer shape which is relatively smooth and similar to the surface shape of the molybdenum foil 12 before the pinch-sealing.

However, the thermal expansion coefficient largely differs between the molybdenum foil 12 and the quartz glass tube 4. Thus, in the case where the interface 12*a* is a smooth planer shape, if the arc tube 2 is lightened or turned on, the exfoliation may likely occur between the molybdenum foil 12 and the quartz glass tube 4 due to the shearing stress $\tau$ caused by the difference of the thermal expansion coefficients therebetween. If such an exfoliation occurs, there arises a problem that the leakage may occurs at the arc tube 2 and hence the life time of the arc tube becomes quite short.

SUMMARY OF THE INVENTION

The present invention has been performed in view of the aforesaid circumstance and an object of the present invention is to provide an arc tube and fabricating method thereof which can effectively prevent the occurrence of exfoliation between a molybdenum foil and a quartz glass tube which causes leakage.

In order to attain the aforesaid object, in the present invention, the pinch-sealing for the first one of the pair of molybdenum foils is not performed by flowing inactive gas within a quartz glass tube like the prior art but performed in a manner that the one end portion of the quartz glass tube is sealed, then the pinch-sealing is performed while air within the quartz glass tube is exhausted from the other end portion thereof so that pressure within the quartz glass tube becomes in a negative pressure state of a predetermined pressure and a pinch seal estimation portion of the quartz glass tube is heated, whereby fine concave and convex portions are formed on the interfaces between the molybdenum foils and the quartz glass tube thus having been pinch-sealed thereby to place the molybdenum foils and the quartz glass tube in an engage state to each other.

That is, in this invention, the arc tube according to the present invention is characterized in that, in the arc tube wherein a pair of molybdenum foils are pinch-sealed at both ends of a spherical portion of a quartz glass tube, the surface roughness of the molybdenum foils at the interfaces between the molybdenum foils and the quartz glass tube is set to be 1 $\mu$m (reference length of 0.08 mm) or more at ten-point average roughness.

In order to obtain such an arc tube, in this invention, the arc tube fabricating method according to the present invention is characterized in that, in a method for fabricating the arc tube, in which a pair of molybdenum foils are pinch-sealed at both ends of a spherical portion of a quartz glass tube, by sequentially pinch-sealing the pair of molybdenum foils, first one of the pair of molybdenum foils is pinch-sealed in a manner that the first one of the pair of molybdenum foils is inserted into the quartz glass tube thereby to seal one end portion of the quartz glass tube, and then a pinch seal estimation portion of the quartz glass tube is squeezed by a pincher while air within the quartz glass tube is exhausted from the other end thereof so that pressure within the quartz glass tube is in a negative pressure state of 100 torr or less and while heating the pinch seal estimation portion.

In this invention, "the interfaces between the molybdenum foils and the quartz glass tube" means both main and rear surfaces of each of the molybdenum foils and the surface roughness of the end portions of each of the molybdenum foils is not particularly limited.

In this invention, the concrete method for "sealing the one end portion of the quartz glass tube" is not particularly limited. For example, a method for heating and squeezing the one end portion of the quartz glass tube and heat-sealing by shrink-seal or the like, a method for choking the one end portion of the quartz glass tube by other member, or the like may be employed.

Since the arc tube according to the present invention is arranged in a manner that the surface roughness of the molybdenum foils at the interfaces between the molybdenum foils and the quartz glass tube is set to be 1 μm (reference length of 0.08 mm) or more at ten-point average roughness, the coupling intensity between the quartz glass tube and the respective molybdenum foils can be made sufficiently high. Thus, since the molybdenum foils and the quartz glass tube engage to each other by means of the fine concave and convex portions formed on the interfaces and the contact area between the molybdenum foils and the quartz glass tube is increased, at the time of turning-on of the arc tube, the exfoliation between the molybdenum foils and the quartz glass tube due to the difference of the thermal expansion coefficients therebetween can be prevented from being occurred in. Thus, the leakage of the arc tube can be prevented and the life time thereof can be made longer.

In the arc tube fabricating method according to the present invention, first one of the pair of molybdenum foils is pinch-sealed in a manner that the first one of the pair of molybdenum foils is inserted into the quartz glass tube thereby to seal one end portion of the quartz glass tube, and then a pinch seal estimation portion of the quartz glass tube is squeezed by a pincher while air within the quartz glass tube is exhausted from the other end thereof so that pressure within the quartz glass tube is set in a negative pressure state of 100 torr or less and while heating the pinch seal estimation portion. Thus, the arc tube fabricating method according to the present invention has the following function and effects.

Since the pressure within the quartz glass tube is maintained in a negative pressure state of 100 torr or less, the inner wall surface of the pinch seal estimation portion thus heated is attracted to the molybdenum foil side. Thus, when the squeeze is performed in this state, the fine concave and convex portions are formed on the interfaces between the molybdenum foils and the quartz glass tube. Further, since the air within the quartz glass tube is continuously exhausted from the other end thereof until the completion of the heating and squeezing processes, unnecessary gas generated at the heating process from the inner portion of the material of the quartz glass tube and the electrode assemblies can be efficiently removed.

If the surface roughness of the respective molybdenum foils at the interfaces between the molybdenum foils and the quartz glass tube is set to be 1 μm (reference length of 0.08 mm) or more at ten-point average roughness, the surface roughness of the molybdenum foils before the pinch-sealing is not limited particularly. However, when the surface roughness itself of the molybdenum foils is set to be 1 μm (reference length of 0.08 mm) or more at ten-point average roughness, in addition to the function of forming the fine concave and convex portions due to the aforesaid fabricating method, fine concave and convex portions can be formed more surely on the interfaces between the respective molybdenum foils and the quartz glass tube in the completed product state of the arc tube.

The heated temperature of the pinch seal estimation portion is not limited to a particular temperature so long as the quartz glass tube can be melted. However, since the quartz glass starts melting about 1,700° C., when the heated temperature is set in a range of 2,000° C. to 2,300° C., the inner wall surface of the pinch seal estimation portion can be effectively attracted to the molybdenum foil side by the negative pressure. As a consequence, the fine concave and convex portions can be formed surely on the interfaces between the respective molybdenum foils and the quartz glass tube.

As described above, in the fabricating method of the arc tube, the concrete method for sealing the one end portion of the quartz glass tube is not limited to a particular method. However, if the sealing process is performed by the provisional pinch-sealing process in which the one end portion of the quartz glass tube is sealed while sandwiching the part of the molybdenum foil, the positioning of the molybdenum foil at the time of the pinch-sealing performed thereafter can be performed surely and accurately.

DESCRIPTION OF THE PREFERRED EMBODIMENTS

An embodiment of the present invention will be described with reference to the accompanying drawings.

Figure 1:
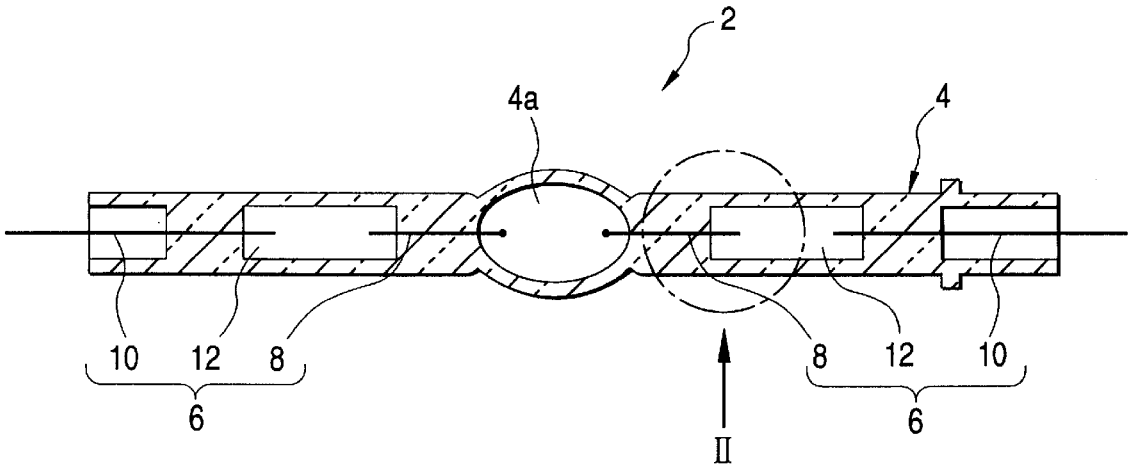
FIG. 1 is a sectional view showing an arc tube according to an embodiment of the present invention.
Figure 2:
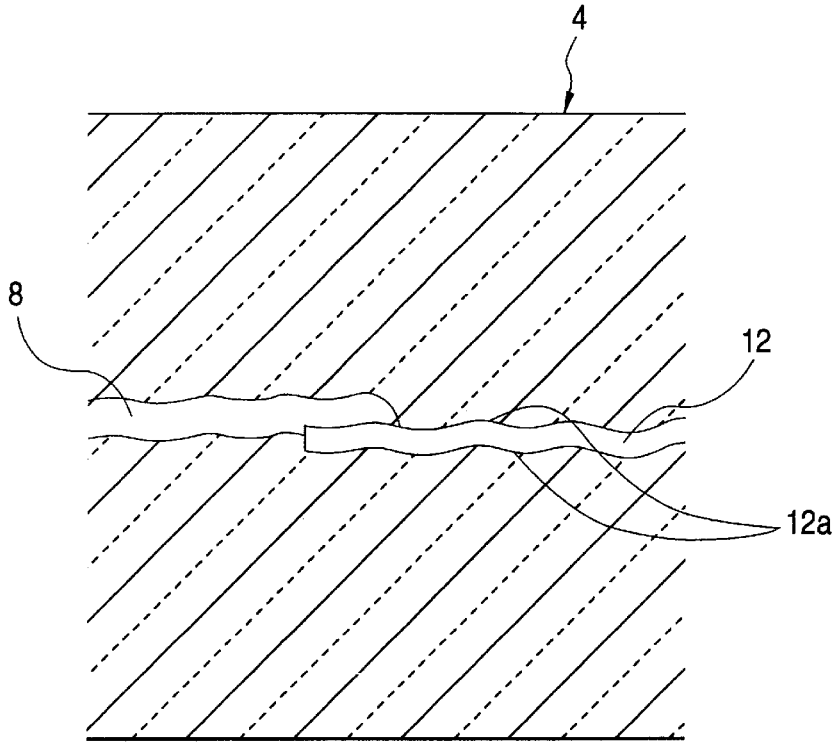
FIG. 2 is an enlarged sectional diagram of the arc tube seen from the direction shown by an arrow II in FIG. 1.

FIG. 1 is a sectional diagram showing an arc tube 2 according to an embodiment of the present invention, and FIG. 2 is an enlarged sectional diagram of the arc tube seen from the direction shown by an arrow II in FIG. 1.

As described above, the arc tube 2 is configured by a quartz glass tube 4 having a spherical portion 4*a* formed at the center portion thereof and a pair of electrode assemblies 6 provided at both sides of the spherical portion 4*a* within the quartz glass tube 4. Each of the electrode assemblies 6 is formed in a manner that an electrode rod 8 is coupled to a lead wire 10 through a molybdenum foil 12. Further, each of the electrode assemblies 6 is pinch-sealed by the quartz glass tube 4 at the portion around the molybdenum foil 12.

Each of the foils 12 of the arc tube 2 according to the embodiment is formed by adding doping material to molybdenum as a main component in a manner that a thickness thereof is about 20 μm and fine concave and convex portions are formed on the interfaces 12*a* between the molybdenum foil 12 and the quartz glass tube 4 as shown in FIG. 2. The surface roughness of the molybdenum foil 12 at the interfaces 12*a* between the molybdenum foil 12 and the quartz glass tube 4 is set to be 1 μm (reference length of 0.08 mm) or more at ten-point average roughness. Fine concave and convex portions are also formed on the interfaces between the quartz glass tube 4 and the electrode rod 8 at a part of the electrode rod 8 which was pinch-sealed together with the molybdenum foil 12.

The respective electrode assemblies 6 are sequentially pinch-sealed, and the pinch-sealing for the first one of the electrode assemblies 6 (hereinafter referred to as "first pinch-sealing) is performed in accordance with the process shown in FIG. 3.

Figure 3:
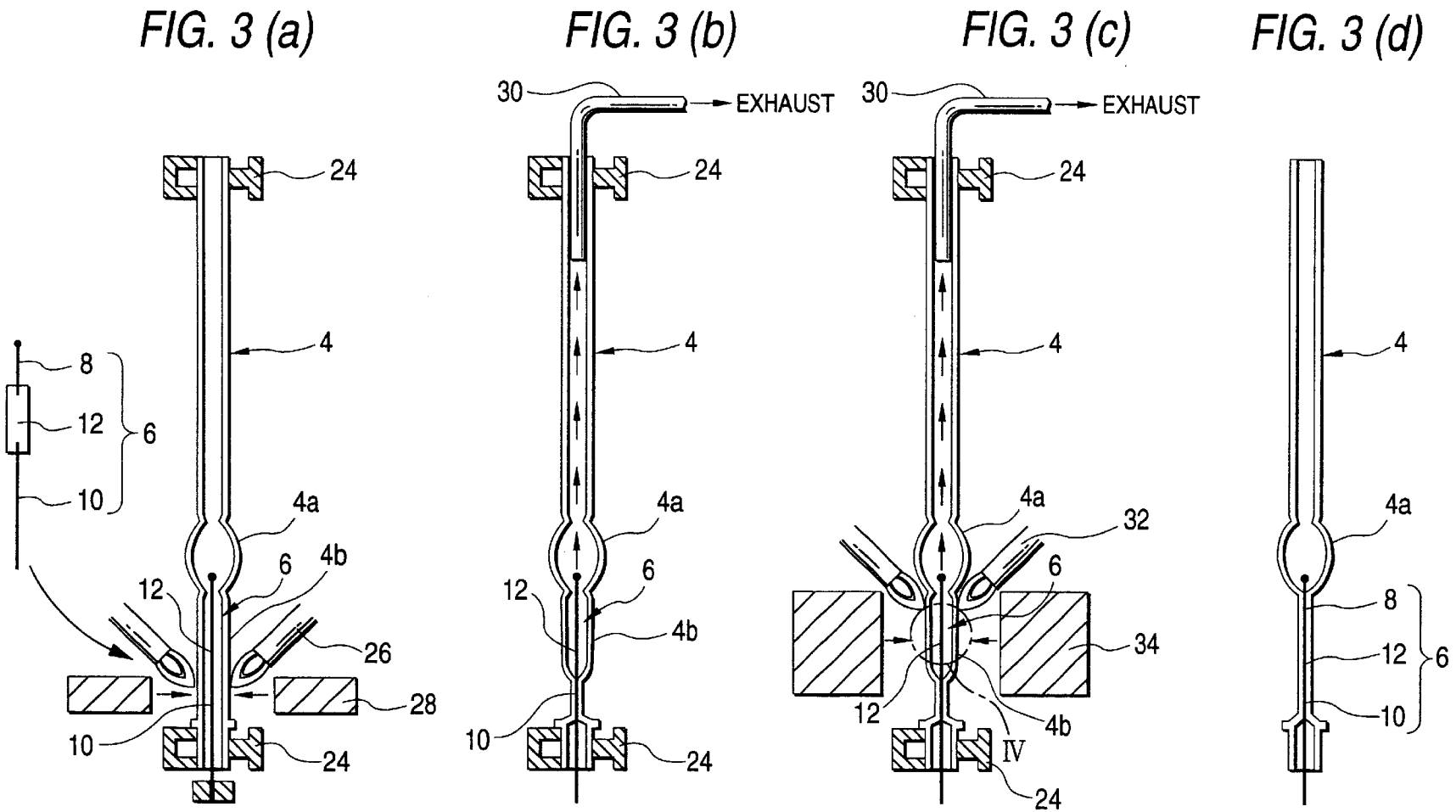
FIGS. 3(*a*)–3(*d*) are Diagrams showing the first pinch-sealing process in the method for fabricating the arc tube according to the embodiment.

First, as shown in (*a*) of FIG. 3, the electrode assembly 6 is inserted within the quartz glass tube 4, which is supported by a pair of upper and lower chucks 24, from the lower direction thereof to place the molybdenum foil 12 in the vicinity of the spherical portion 4*a*. Then, the lower end portion (one end portion) of the quartz glass tube 4 is sealed. This sealing is performed by a provisional pinch-sealing process for pinch-sealing a part of the spherical portion 4*a* in advance in a manner that both a part of the molybdenum foil 12 and a part of the lead wire 10 are sandwiched by a provisional pincher 28 while heating by a burner 26 a portion within the quartz glass tube 4 surrounding a coupling portion between the molybdenum foil 12 and the lead wire 1O.

Then, as shown in (*b*) of FIG. 3, a suction pipe 30 is inserted into the upper end portion (the other portion) of the quartz glass tube 4 thereby to start exhausting the air within the quartz glass tube 4.

The pressure within the quartz glass tube 4 is thus lowered by the exhaust of the air and maintained in a negative pressure state of 100 torr or less (preferably, in a range of 0.1 torr to 0.01 torr). In this state, as shown in (*c*) of FIG. 3, the pinch-sealing (formal pinch-sealing) is performed in a manner that both the molybdenum foil 12 and a part of the electrode rod 8 are sandwiched by a pincher 34 while the pinch seal estimation portion 4*b* of the quartz glass tube 4 is heated by a burner 32 at the temperature in a range of 2,000° C. to 2,300° C. As a result, the intermediate product of an arc tube shown in (*d*) of FIG. 3 is obtained.

Figure 4:
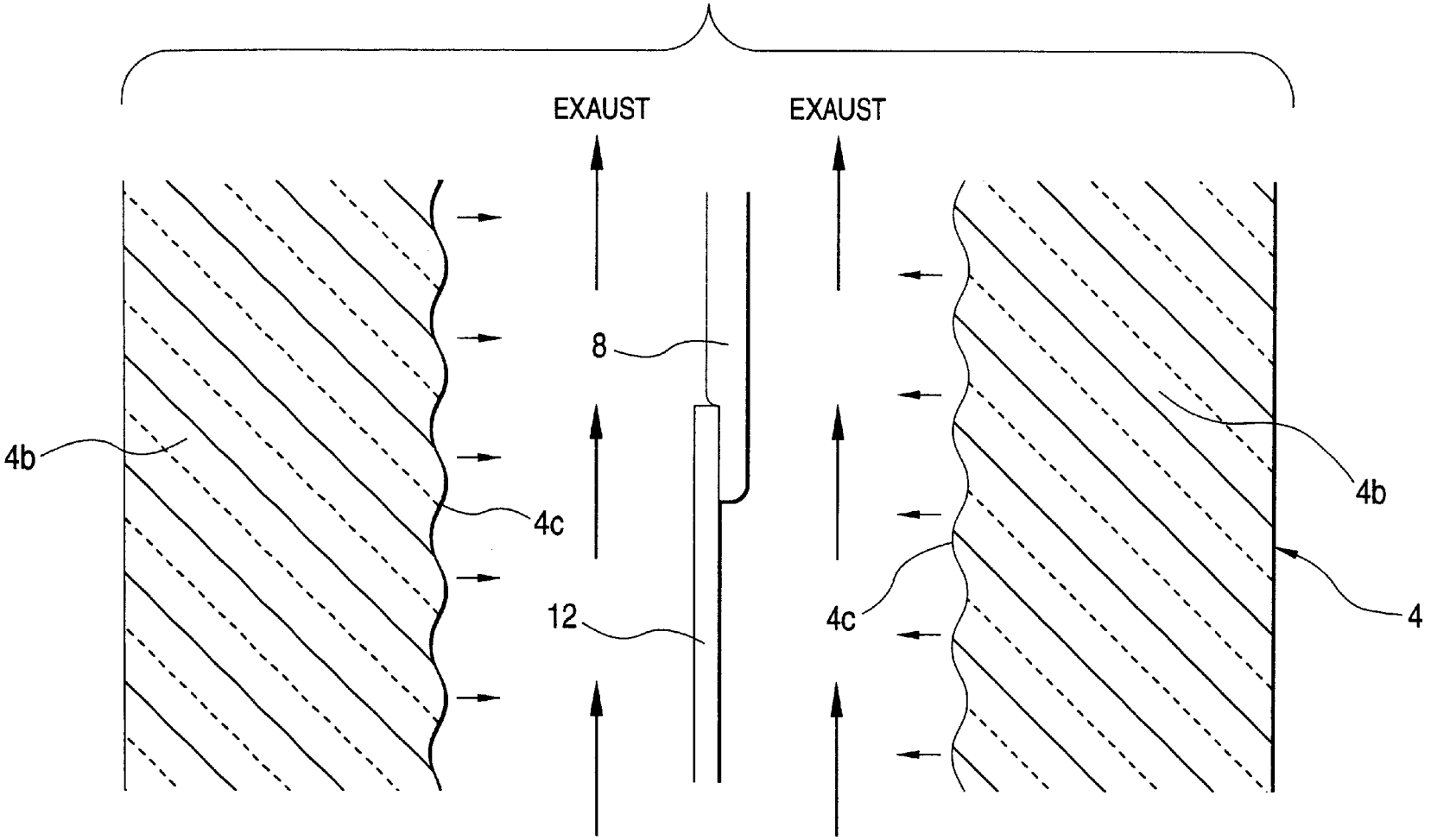
FIG. 4 is an enlarged diagram of the portion of the quartz glass tube indicated by a symbol IV in (*c*) of FIG. 3.

FIG. 4 is an enlarged diagram of the portion of the quartz glass tube indicated by a symbol IV in (*c*) of FIG. 3.

At the time of the formal pinch-sealing, since the pressure within the quartz glass tube 4 is maintained in a negative pressure state of 100 torr or less, the inner wall surface 4*c* of the pinch seal estimation portion 4*b* is attracted to the molybdenum foil 12 side and so configured in an uneven shape as shown in this figure. When the quartz glass tube is squeezed in this state, fine concave and convex portions are formed on each of the interfaces 12*a* between the molybdenum foil 12 and the quartz glass tube 4 and the interfaces between the electrode rod 8 and the quartz glass tube 4, so that the arc tube having the sectional configuration shown in FIG. 2 can be obtained.

Figure 5:
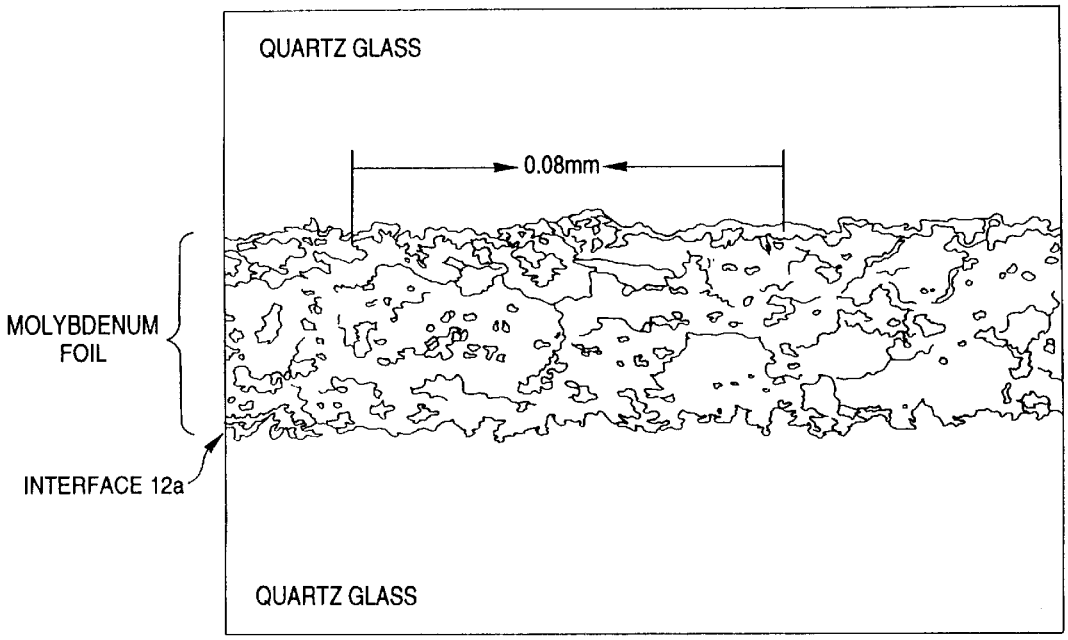
FIG. 5 is a photomicrograph showing the state of the interface between a molybdenum foil and a quartz glass tube at the portion where the first pinch-sealing was performed in the arc tube according to the embodiment.

FIG. 5 is a figure of an enlarged illustrative view of the state of the interface 12*a* between the molybdenum foil 12 and the quartz glass tube 4 at the portion where the first pinch-sealing was performed.

In the figure, the belt-shaped portion extending to the left and right directions at the center of the figure is the molybdenum foil 12 and the upper and lower portions on both sides of the molybdenum foil is the quartz glass tube 4.

Figure 6:
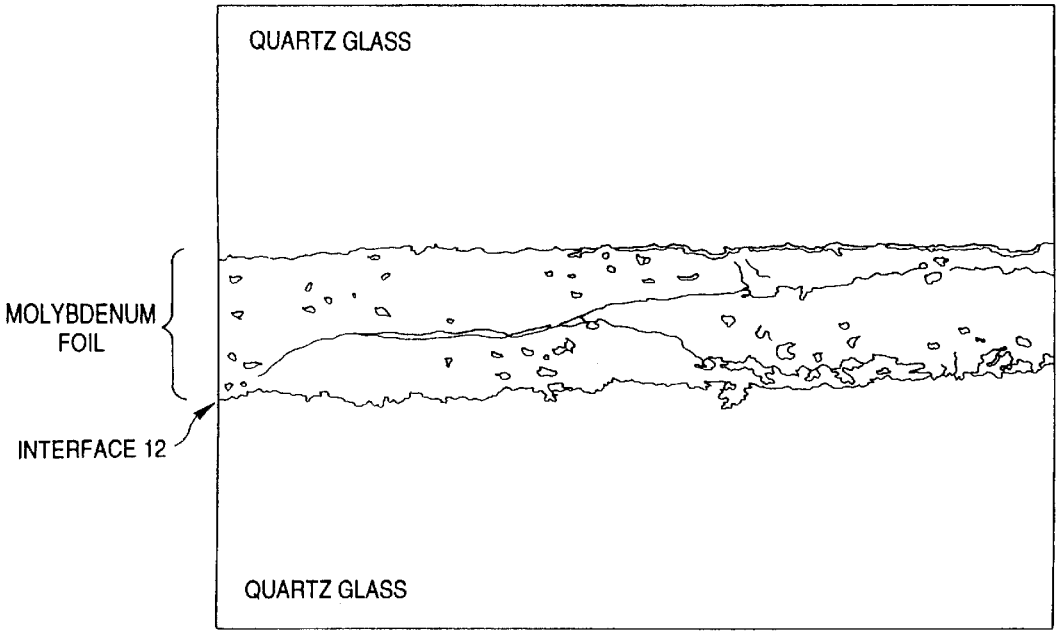
FIG. 6 is a photomicrograph showing the state of the interface between a molybdenum foil and a quartz glass tube at the portion where the first pinch-sealing was performed in the conventional arc tube.
Figure 7:
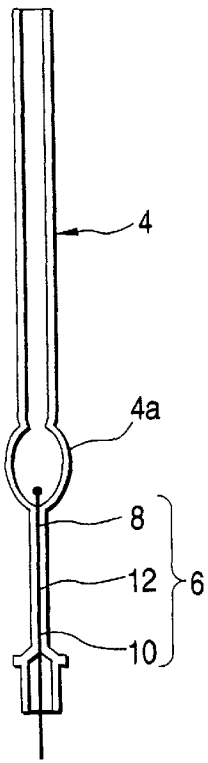
FIGS. 7(*a*)–7(*d*) are Diagrams showing the first pinch-sealing process in the conventional method for fabricating the arc tube.
Figure 7:
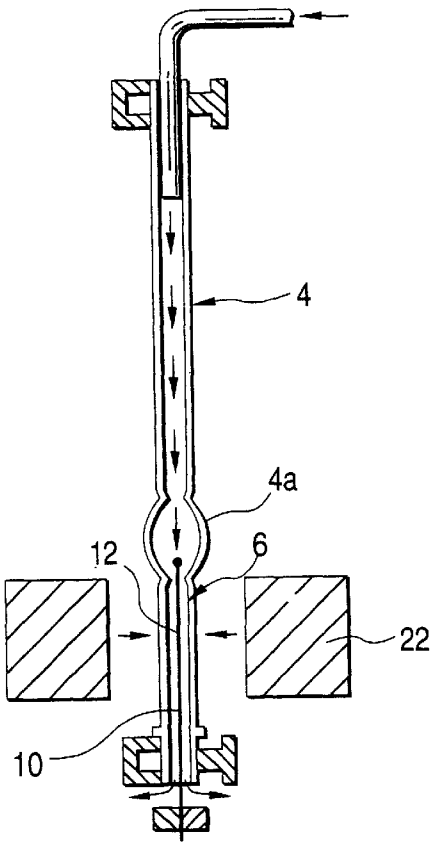
Figure 7:
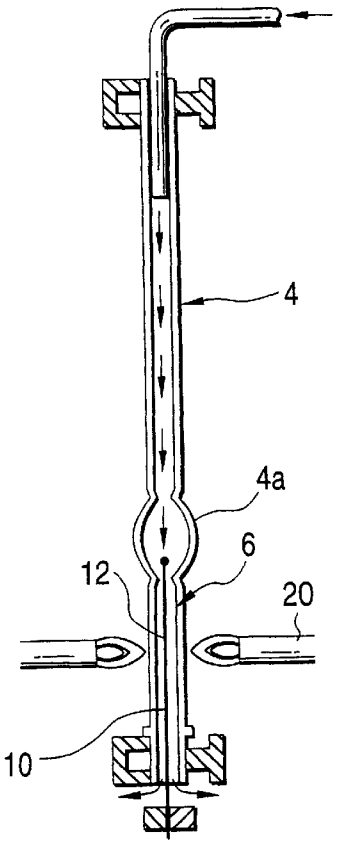
Figure 7:
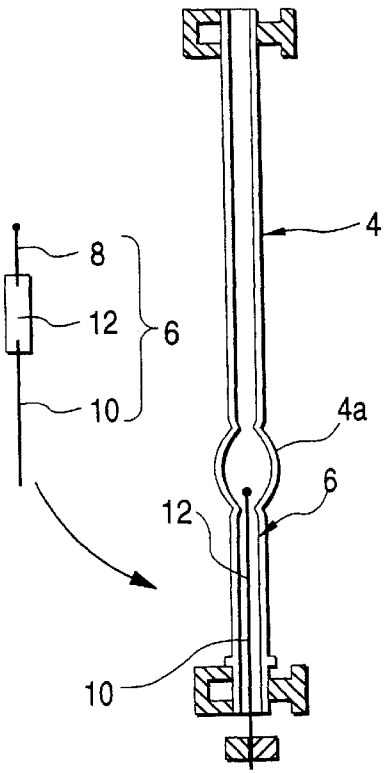
Figure 8:
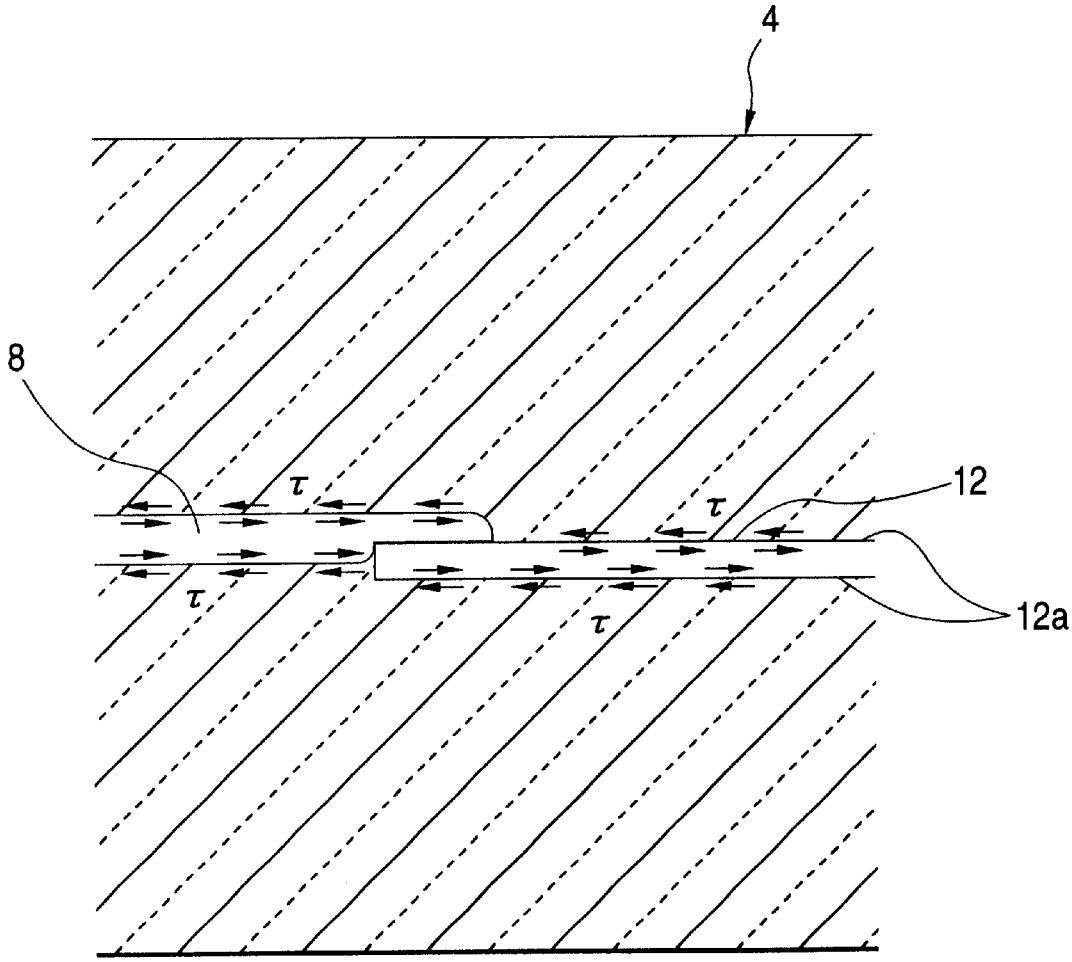
FIG. 8 is a diagram similar to FIG. 2 and showing the first pinch-sealing portion in the conventional arc tube.

FIG. 6 is a figure of an enlarged illustrative view similar to FIG. 5 showing the conventional arc tube where FIG. 5 and FIG. 6 have the same scale of the enlargement.

As shown in this figure, the interfaces between the molybdenum foil and the quartz glass tube of the conventional arc tube are remained in a relatively smooth and planeshaped state, which is the original surface state of the molybdenum foil. Thus, when the arc tube is turned on, the exfoliation may likely occur between the molybdenum foil and the quartz glass tube due to the shearing stress caused by the difference of the thermal expansion coefficient therebetween.

To the contrary, as shown in FIG. 5, in the arc tube 2 according to the embodiment, fine concave and convex portions of which each size is not less than 1 $\mu$m are formed on each of the interfaces 12*a* between the molybdenum foil 12 and the quartz glass tube 4. Further, more than ten of said concave and convex portions can be identified in the range of 0.08 mm of the reference length so that the molybdenum foil 12 and the quartz glass tube 4 are placed in an engaged state and the contact area therebetween increases. As a consequence, the exfoliation due to the shearing stress can be effectively prevented from being occurred even if there is a difference of the thermal expansion coefficients between the molybdenum foil 12 and the quartz glass tube 4.

The fabricating process of the arc tube after the pinch-sealing of the first one of the electrode assemblies 6 will be explained briefly.

After the air within the quartz glass tube 4 is. exhausted from the upper end portion thereof, chemicals are supplied into the spherical portion 4*a* and the second one of the electrode assemblies 6 is inserted into the quartz glass tube 4 in a manner that the molybdenum foil 12 thereof is placed in the vicinity of the spherical portion 4*a*. Thereafter, the gas within the quartz glass tube 4 is exhausted, then xenon gas is filled within the quartz glass tube 4, and the portion near the top end portion of the quartz glass tube 4 is heated by a burner and sealed. Then, the portion of the quartz glass tube 4 surrounding the molybdenum foil 12 is heated by a burner, and the thus heated and softened portion of the quartz glass tube 4 is squeezed by a pincher thereby to pinch-seal the electrode assembly 6 to the quartz glass tube 4. The unnecessary portion at the upper portion of the quartz glass tube 4 of both the electrode assemblies 6 thus pinch-sealed in this manner is cut, whereby a finished product of the arc tube 2 can be obtained.

As described in detail, since the arc tube 2 according to the embodiment is arranged in a manner that the surface roughness of the respective molybdenum foils 12 at the interfaces 12*a* between the molybdenum foils 12 and the quartz glass tube 4 is set to be 1 $\mu$m (reference length of 0.08 mm) or more at ten-point average roughness, the coupling intensity between the quartz glass tube 4 and the respective molybdenum foils 12 can be made sufficiently high. Thus, since the molybdenum foils and the quartz glass tube engage to each other by means of the fine concave and convex portions formed on the interfaces 12*a* and the contact area between the molybdenum foils and the quartz glass tube is large, at the time of turning-on of the arc tube 2, the exfoliation between the molybdenum foils 12 and the quartz glass tube 4 due to the difference of the thermal expansion coefficients therebetween can be prevented from being occurred in advance (in this respect, the linear expansion coefficient of the molybdenum is $50\times10^{-7}$/deg, while that of the quartz glass is $5.5\times10^{-7}$/deg). Thus, the leakage of the arc tube 2 can be prevented and the life time thereof can be made longer.

The leakage of the arc tube 2 can be prevented if there occurs no exfoliation between the molybdenum foil 12 and the quartz glass tube 4. In the present embodiment, since the electrode rods and the quartz glass tube engage to each other by means of the fine concave and convex portions formed on the interfaces therebetween and the contact area between the electrode rods and the quartz glass tube is increased, at the time of turning-on of the arc tube 2, the exfoliation between the electrode rods 8 and the quartz glass tube 4 due to the difference of the thermal expansion coefficients therebetween can also be prevented from being occurred in advance (in this respect, the linear expansion coefficient of tungsten forming the electrode rod 8 is $45\times10^{-7}$/deg). Thus, the leakage of the arc tube 2 can be prevented more surely.

In the embodiment in the fabricating process of the arc tube 2, the pinch-sealing for the first one of the electrode assemblies 6 is performed in a manner that the electrode assembly 6 is inserted into the quartz glass tube 4 to the predetermined position thereby to seal the lower end portion of the quartz glass tube 4, and then the pinch seal estimation portion 4*b* is squeezed by the pincher 34 while air within the quartz glass tube 4 is exhausted from the top end portion of the quartz glass tube 4 so that pressure within the quartz glass tube 4 is maintained in a negative pressure state of 100 torr or less and while heating the pinch seal estimation portion 4*b*. Thus, the fine concave and convex portions can be formed on the interfaces 12*a* between the molybdenum foil 12 and the quartz glass tube 4. Further, since the air within the quartz glass tube 4 can be continuously exhausted from the upper end portion thereof until the completion of the heating and squeezing processes, unnecessary gas generated at the heating process from the inner portion of the material of the quartz glass tube 4 and the electrode assemblies 6 can be efficiently removed.

Further, in the embodiment, since the heated temperature of the pinch seal estimation portion 4*b* is set in a range of 2,000° C. to 2,300°C. which is sufficiently higher than the melting start temperature (about 1,700° C.) of the quartz glass tube 4, the inner wall surface 4*c* of the pinch seal estimation portion 4*b* can be effectively attracted to the molybdenum foil side by the negative pressure. As a consequence, the fine concave and convex portions can be formed surely on the interfaces 12*a* between the respective molybdenum foils 12 and the quartz glass tube 4.

Furthermore, in the embodiment, since the sealing of the lower end portion of the quartz glass tube 4 for generating the negative pressure state is performed by the provisional pinch-sealing process in which the lower end portion of the quartz glass tube is sealed while sandwiching the part of the molybdenum foil 12, the positioning of the molybdenum foil 12 at the time of the formal pinch-sealing performed thereafter can be performed surely and accurately.

Furthermore, in the embodiment, when the surface roughness itself of the molybdenum foils 12 before the pinch-sealing is set to be 1 $\mu$m (reference length of 0.08 mm) or more at ten-point average roughness, in addition to the function of forming the fine concave and convex portions due to the aforesaid fabricating method, fine concave and convex portions can be formed more surely on the interfaces between the respective molybdenum foils 12 and the quartz glass tube in the completed product state of the arc tube 2.

What is claimed is:

1. In a method for fabricating an arc tube, in which a pair of molybdenum foils are pinch-sealed at both ends of a spherical portion of a quartz glass tube, by sequentially pinch-sealing said pair of molybdenum foils, said method is characterized in that a first one of said pair of molybdenum foils is pinch-sealed in such a manner that after said first one of said pair of molybdenum foils is inserted into said quartz glass tube and one end portion of said quartz glass tube is sealed, a pinch seal estimation portion of said quartz glass tube is then squeezed by a pincher while air within said quartz glass tube is exhausted from the other end thereof and said pinch seal estimation portion is heated so that pressure within said quartz glass tube is in a negative pressure state of not more than 100 torr, further characterized in that the sealing of said one end portion of said quartz glass tube is performed by a provisional pinch-sealing process in which said one end portion of said quartz glass tube is sealed while sandwiching a part of said molybdenum foil.

2. A method of fabricating an arc tube according to claim 1, wherein the ten-point average surface roughness of the molybdenum foils at the interfaces between the molybdenum foils and the quartz glass tube before pinch-sealing is no less than 1 $\mu$m (using JIS B0601 with a reference length of 0.08 mm).

3. A method for fabricating an arc tube according to claim 1, characterized in that surface roughness of said molybdenum foils at the interfaces between said molybdenum foils and said quartz glass tube before the pinch-sealing is set to be no less than 1 $\mu$m (reference length of 0.08 mm) at ten-point average roughness.

4. A method for fabricating an arc tube according to claim 1, characterized in that heated temperature of said pinch seal estimation portion is set in a range from 2,000° C. to 2,300° C.

5. A method of fabricating an arc tube in which a pair of molybdenum foils are sealed at respective ends of a spherical portion of a quartz glass tube, by sequentially sealing said pair of molybdenum foils, comprising the steps of:

i) inserting one of the molybdenum foils into an end portion of the quartz glass tube so that one end of the molybdenum foil is in the vicinity of the spherical portion, ii) sealing the end portion of the quartz glass tube, through which the molybdenum foil is inserted, to the molybdenum foil by a provisional pinch-sealing process in which said one end portion is sealed while sandwiching part of said molybdenum foil, iii) heating a pinch-seal portion of the quartz glass tube between the spherical portion and the sealed end portion, iv) exhausting the air from within the quartz glass tube so that the pressure within the quartz glass tube is in a negative pressure state of 100 torr or less, and v) squeezing and thereby pinch-sealing the heated pinch-seal portion of the quartz glass tube.

6. A method of fabricating an arc tube according to claim 5, wherein the heated temperature of the pinch-seal portion is in a range from 2,000° C. to 2,300° C. so as to create the negative pressure in the quartz glass tube.

7. A method of fabricating an arc tube according to claim 5, wherein, in step (iv), the pressure in the quartz glass tube is in a negative state in a range 0.01 to 0.1 torr.

* * * * *